United States Patent [19]

Jonas et al.

[11] Patent Number: 4,663,078

[45] Date of Patent: May 5, 1987

[54] FUSIBLE, ELECTRICALLY CONDUCTIVE MIXTURES

[75] Inventors: Friedrich Jonas, Aachen; Jürgen Hocker, Bergisch-Gladbach, both of Fed. Rep. of Germany

[73] Assignee: Bayer Aktiengesellschaft, Leverkusen, Fed. Rep. of Germany

[21] Appl. No.: 793,226

[22] Filed: Oct. 31, 1985

[30] Foreign Application Priority Data

Nov. 9, 1984 [DE] Fed. Rep. of Germany ..... 3440914

[51] Int. Cl.[4] ..... H01B 1/06

[52] U.S. Cl. ..... 252/500

[58] Field of Search ..... 252/500; 524/236

[56] References Cited

U.S. PATENT DOCUMENTS

| | | | |
|---|---|---|---|
| 3,424,698 | 1/1969 | Lupinski et al. | 252/500 |
| 4,293,452 | 10/1981 | Fox et al. | 252/518 |
| 4,359,411 | 11/1982 | Kim et al. | 252/500 |
| 4,478,751 | 10/1984 | Jonas et al. | 252/500 |
| 4,529,538 | 7/1985 | Kim | 252/500 |
| 4,568,485 | 2/1986 | Jonas et al. | 252/518 |
| 4,568,494 | 2/1986 | Jonas et al. | 252/500 |

*Primary Examiner*—Josephine L. Barr

*Attorney, Agent, or Firm*—Connolly and Hutz

[57] ABSTRACT

Fusible mixtures of high electrical conductivity which consist of from 0.5 to 99%, by weight of a TCNQ complex.

4 Claims, No Drawings

FUSIBLE, ELECTRICALLY CONDUCTIVE MIXTURES

Complex salts of the 7,7,8,8-tetracyano-p-quinodimethane anion (TCNQ) of the formula

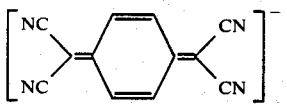

I neutral 7,7,8,8-tetracyano-p-quinodimethane (TCNQ) and inorganic or organic cations are known as electrically-conductive compounds.

These comlexes may be prepared by reaction of TCNQ with organic cation iodides ([J. Am. Chem. Soc. 84, 3374–3387 (1962)], for example in accordance with the following scheme:

$$4TCNQ + 3M^+I^- \rightarrow 2M^+.TCNQ^-.TCNQ + M^+I_3$$

REACTION SCHEMIE I

In this reaction, a TCNQ molecule is reduced by iodide to the TCNQ anion with liberation of iodine.

Another process involves reacting nitrogen-containing heteroaromatic compounds or tertiary amines with p-phenylene-1,4-dimalodinitrile of the formula $H_2TCNQ$ (II) and TCNQ, for example in accordance with the following scheme:

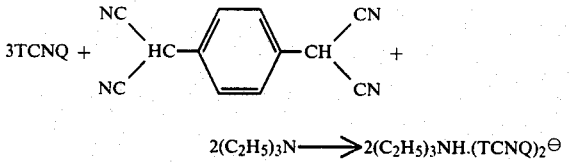

REACTION SCHEME II

The complexes are difficult to process at tempertures above their melting point because in the hitherto known compounds melting and decomposition temperatures are near to each other. It is known from DE-OS No. 3,214,355 that certain TCNQ complexes may be briefly i.e. at most 1 to 2 minutes) heated to temperatures above their melting point without losing electrical conductivity. Temperatures required for processing are very high, which complicates fabrication.

It has been found that mixtures of TCNQ complexes and fusible, low molecular weight organic compounds solid at room temperature may be processed at lower temperatures than the pure TCNQ complexes to form solid, electrically-conductive coatings on substrates without loss of electrical conductivity.

Suitable organic compounds are, for example, optionally substituted, linear or cyclic hydrocarbons, such as octadecane, 1-chloro-octadecane, esters of aliphatic carboxylic acids, such as palmitic acid methyl ester, stearic acid methyl ester, ethylene carbonate; linear or cyclic aliphatic ketones and alcohols, such as cyclododecanone, cyclooctanone; octadecano; optionally substituted, aromatic or araliphatic hydrocarbons, such as naphthalene, anthracene, biphenyl, fluorene, terphenyl; optionally substituted aromatic or araliphatic ketones, such as diphenyl ketone, dibenzyl ketone; optionally substituted aromatic or araliphatic ethers, such as diphenyl ether; optionally substituted aromatic or araliphatic thioethers and sulphones, such as dibenzyl sulphide, diphenyl sulphone; esters of aromaic carboxylic acids, such as 4-chlorobenzoic acid methyl ester, terephthalic acid dimethyl ester; nitriles or aromatic carboxylic acids, such as 4-chlorobenzonitrile; heterocyclic compounds, such as caprolactam, phthalimide.

Melting points of suitable organic compounds are generally above 30° C., preferably above 60° C., but below the melting point of the TCNQ complex. A typical range of melting points is about 60° to about 180° C.

The organic compounds may be used individually or as mixtures. The mixtures according to the present invention containing TCNQ complexes contain from 0.5 to 99%, by weight, preferably from 10 to 90%, by weight, of TCNQ complex (II) and from 1 to 99.5%, by weight, preferably from 10 to 90%, by weight, of one or more of the described organic compounds.

The TCNQ complexes suitable for the preparation of the mixtures according to the invention are known. They correspond to the following formula (II):

$$D.(TCNQ)_n \qquad (II)$$

wherein .

D represents an electron donor or a cation; and n represents a number of from 1 to 5, preferably 2.

Especially suitable CT-complexes correspond to the formula $D^+(TCNQ)^-.(TCNQ)_m$, wherein $D^+$ is a cation and n is 1,2,3 or 4, preferably 1.

These complexes are also known as charge transfer or CT-complexes or radical ion salts and are reviewed in J. Am. Chem. Soc. 84, 3374–3387 (1962).

According to the present invention, it is preferred to use those CT complexes of which the donor component is readily accessible, being derived from an organic compound containing nitrogen and/or oxygen and/or sulphur and/or phosphorus, and which is present as a cation. Examples are cations of the following compounds and the corresponding quaternary ammonium, sulphonium or phosphonium ions: triethylamine, diethylcyclohexylamine, quinoline, benzo-2,3-quinoline, o-phenanthroline, benzthiazole, N-methylbenzimidazole, pyridine, 2,2'-dipyridine, 4,4'-dipyridine, 4,5-dimethylthiazoline, 1-phenylimidazolidine, bis-[-1,3-diphenylimidazolidin-(2)ylidene], bis-[3-methylbenzthiazolin-(2)-ylidene], isoquinoline, triphenylphosphine, trimethylsulphonium ion.

Particularly preferred TCNQ complexes are those of formula (III) wherein D represents a cation corresponding to formula (IV), (V) or (VI) below:

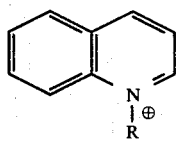

(IV)

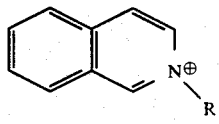

(V)

-continued (VI)

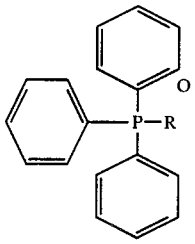

wherein

R represents an optionally substituted aliphatic, cycloaliphatic or araliphatic radical containing from 1 to 30 carbon atoms; and n represents 1 or 2.

The mixtures according to the present invention may be prepared by mixing the individual constituents in solid form by known methods, for example by grinding, mortaring etc. However, the TCNQ complex may also be introduced into a melt of the organic compounds.

The conductivity of the mixtures may be varied within wide limits by varying the ratio of TCNQ complex to organic compound. The mixtures may generally be kept in the melt for at least 5 minutes without losing the electrical properties thereof. The mixtures may also be repeatedly melted.

The melting points of the mixtures according to the present invention depend both upon the melting points of the individual constituents and upon the ratio in which they are mixed. However, they are always distinctly below the melting points of the pure TCNQ complexes which imposes less thermal strain on the TCNQ complexes and provides for easier processing.

In addition, the mixtures according to the present invention may contain other constituents, such as polymeric binders, stabilizers, pigments.

By virtue of the favourable melting and decomposition behaviour thereof, the mixtures according to the present invention may be used for producing electrically-conductive coatings on substrates by melting.

Suitable substrates are glass, metals, metal oxides, organic polymers. Such substrates may be coated by applying melts of the mixtures according to the present invention to pre-heated substrates. The mixtures according to the present invention may also be applied to the coated substrates at room temperature and then melted in a preheated furnace. Both processes give electrically-conductive, firmly-adhering coatings.

The thus-prepared coatings may be used in electrical engineering and in electronics.

EXAMPLES

TCNQ complexes used:

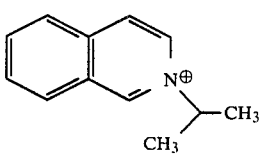

$[TCNQ]_2^{\ominus}$ A

-continued $[TCNQ]_2^{\ominus}$ B

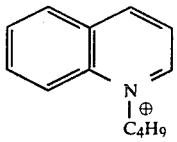

$[TCNQ]_2^{\ominus}$ C:R = $CH_3$

D:R = $-CH(CH_3)_2$

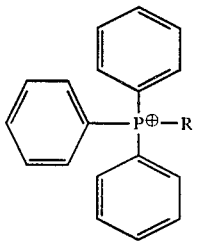

(VI)

$[TCNQ]_2$ E

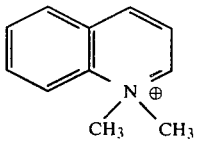

The conductivities of the mixtures were determined by two-electrode measurement under a pressure of 2000 kp/cm$^2$.

Example 1

X g of the TCNQ complex A and Y g of the compound* (see Table) are thoroughly mixed by mortaring and then melted for D minutes in a glass test tube by heating in a metal bath having the temperature T. In every case, thinly liquid melts were obtained. The conductivities of the resolidified melts were determined.

TABLE 1

| X [g] | Y [g] | * | D [mins] | °C. | δ [S/cm] |
|---|---|---|---|---|---|
| 1.0 | — | — | — | — | $3 \times 10^{-2}$ |
| 1.0 | — | — | 4 | 250 | $5 \times 10^{-8}$ |
| 1.0 | 0.1 | naphthalene | 4 | 230 | $2 \times 10^{-2}$ |
| 0.75 | 0.25 | " | 4 | 200 | $3.7 \times 10^{-2}$ |
| 0.75 | 0.25 | " | 10 | 200 | $2.8 \times 10^{-2}$ |
| 0.75 | 0.25 | " | 20 | 200 | $5 \times 10^{-3}$ |
| 0.75 | 0.25 | " | 6 × 4 | 200 | $1.5 \times 10^{-2}$ |
| 1.0 | 0.5 | naphthalene anthracene 1:1 | 6 | 200 | $3.6 \times 10^{-2}$ |
| 1.0 | 0.5 | naphthalene anthracene 1:1 | 6 × 4 | 220 | $1.1 \times 10^{-2}$ |
| 1.0 | 0.5 | naphthalene anthracene 1:1 | 15 | 200 | $8 \times 10^{-3}$ |
| 1.0 | 1.0 | naphthalene | 4 | 200 | $1 \times 10^{-2}$ |
| 1.0 | 1.0 | " | 2 | 250 | $2.6 \times 10^{-2}$ |
| 1.0 | 1.0 | " | 3 | 250 | $1.3 \times 10^{-2}$ |
| 0.5 | 3 | " | 4 | 200 | $9 \times 10^{-3}$ |
| 0.5 | 10 | " | 4 | 200 | $5 \times 10^{-4}$ |
| 0.5 | 15 | " | 6 | 200 | $6 \times 10^{-6}$ |
| 0.5 | 0.5 | biphenyl | 4 | 220 | $5 \times 10^{-3}$ |
| 0.5 | 5.0 | " | 4 | 220 | $10 \times 10^{-5}$ |
| 0.5 | 0.5 | dioxolan-2-one | 4 | 200 | $4 \times 10^{-3}$ |
| 0.5 | 0.5 | benzil | 4 | 200 | $5 \times 10^{-2}$ |
| 0.5 | 0.5 | dibenzylsulphide | 4 | 200 | $6 \times 10^{-2}$ |
| 0.5 | 0.3 | diphenylsulphone | 4 | 200 | $1.2 \times 10^{-2}$ |

Example 2

The process is as in Example 1 using the TCNQ complexes B–E.

TABLE 2

| TCNQ complex | X [g] | Y [g] | * | D [mins] | °C. | δ [S/cm] |
|---|---|---|---|---|---|---|
| B | 1.0 | — | — | 4 | 240 | $7 \times 10^{-9}$ |
| B | 0.5 | 0.4 | naphthalene | 2 | 200 | $3.2 \times 10^{-2}$ |
| B | 0.5 | 0.5 | " | 4 | 200 | $1.1 \times 10^{-2}$ |
| B | 0.5 | 0.5 | " | 1 | 250 | $1.5 \times 10^{-2}$ |
| C | 1.0 | — | — | 4 | 270 | $6 \times 10^{-7}$ |
| C | 0.5 | 0.5 | naphthalene | 4 | 220 | $2 \times 10^{-4}$ |
| C | 0.5 | 0.2 | " | 4 | 220 | $1 \times 10^{-3}$ |
| C | 0.5 | 0.1 | " | 4 | 220 | $1.5 \times 10^{-3}$ |
| D | 0.5 | 0.5 | " | 4 | 200 | $1.4 \times 10^{-3}$ |
| D | 0.5 | 0.5 | " | 6 | 200 | $1.2 \times 10^{-3}$ |
| D | 0.5 | 0.25 | " | 2 | 250 | $4.1 \times 10^{-3}$ |
| D | 0.5 | 0.25 | " | 4 | 250 | $2 \times 10^{-3}$ |
| D | 0.5 | 0.25 | diphenyl | 4 | 200 | $1.2 \times 10^{-4}$ |
| E | 0.5 | 0.5 | naphthalene | 4 | 200 | $5 \times 10^{-2}$ |
| E | 0.5 | 0.5 | " | 4 | 180 | $7 \times 10^{-2}$ |
| E | 0.5 | 0.5 | " | 10 | 180 | $4.6 \times 10^{-2}$ |
| E | 0.5 | 0.5 | " | 15 | 180 | $1.4 \times 10^{-2}$ |

It is clear from Examples 1 and 2 that the mixtures according to the present invention have lower melting points than the pure TCNQ complexes for greatly increased stability at high temperatures and show high electrical conductivity.

Example 3

Mixtures of 2 g of each of the TCNQ complexes A–E and 2 g of naphthalene were melted at 200° C. The melts obtained were applied in liquid form the pre-heated (180° C.) glass plates or aluminium plates (layer thickness approximately 0.5 mm). After cooling, hard, glossy coatings of high electrical conductivity were obtained in every case.

Example 4

2 g TCNQ complex B are introduced with stirring at 160° C. into a melt of 2 g of naphthalene. The melt obtained is thinly liquid and, after cooling, has an electrical conductivity δ of $2 \times 10^{-2}$ S/cm.

I claim:

1. A fusible mixture of high electrical conductivity which comprises from 0.5 to 99%, by weight, of a TCNQ complex corresponding to the following formula:

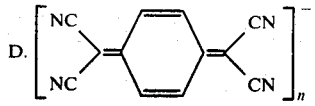

wherein

D represents an electron donor or a cation; and n represents an integer of from 1 to 5;

and from 1 to 99.5%, by weight, of one or more fusible, low molecular weight organic compounds, solid at room temperature, and selected from the group consisting of ethylene carbonate, aromatic hydrocarbons aromatic ketones, araliphatic or aromatic thioethers and araliphatic or aromatic sulphones.

2. A mixture as claimed in claim 1 wherein from 10 to 90%, by weight, of complex and from 10 to 90%, by weight, or organic compound are present.

3. A mixture as claimed in claim 1 or claim 2 wherein the counter-ion to the TCNQ radical anion is an organic cation.

4. A mixture as claimed in claim 3 wherein the cation corresponds to one of the formulae A—C below:

(A)

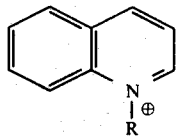

(B)

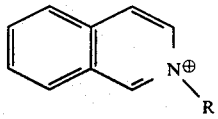

(C)

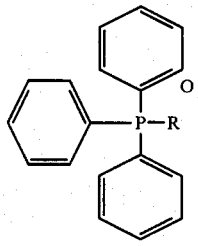

wherein

R represents an optionally substituted aliphatic, cycloaliphatic or araliphatic radical containing from 1 to 30 carbon atoms.

* * * * *